US006974123B2

(12) United States Patent
Latvys

(10) Patent No.: US 6,974,123 B2
(45) Date of Patent: Dec. 13, 2005

(54) PLATFORM CENTERING DEVICE

(75) Inventor: Evaldas Latvys, Itasca, IL (US)

(73) Assignee: Advance Lifts, Inc., St. Charles, IL (US)

( * ) Notice: Subject to any disclaimer, the term of this patent is extended or adjusted under 35 U.S.C. 154(b) by 611 days.

(21) Appl. No.: 10/115,514

(22) Filed: Apr. 3, 2002

(65) Prior Publication Data

US 2003/0189194 A1 Oct. 9, 2003

(51) Int. Cl.[7] ..... B66F 3/22
(52) U.S. Cl. ..... 254/122; 254/124
(58) Field of Search ..... 259/122, 124, 259/9 R, 9 B, 9 C; 182/157, 191, 158, 12 A; 74/521

(56) References Cited

U.S. PATENT DOCUMENTS

| | | | | |
|---|---|---|---|---|
| 3,843,115 A | | 10/1974 | Di Fulvio et al. | |
| 3,865,347 A | * | 2/1975 | Pase | 254/124 |
| 3,902,616 A | | 9/1975 | Santic et al. | |
| 4,175,644 A | * | 11/1979 | Sikli | 254/122 |
| 4,684,314 A | | 8/1987 | Luth | |
| 4,756,503 A | | 7/1988 | Fujita | |
| 4,858,482 A | | 8/1989 | Knudsen | |
| 5,052,881 A | | 10/1991 | Keffeler et al. | |
| 5,192,053 A | | 3/1993 | Sehlstedt | |
| 5,394,959 A | | 3/1995 | Cullity et al. | |
| 5,855,359 A | * | 1/1999 | Chipperfield | 254/122 |
| 6,012,621 A | * | 1/2000 | Hoium et al. | 254/134.4 |
| 6,257,372 B1 | | 7/2001 | Schirmer | |

* cited by examiner

*Primary Examiner*—Robert C. Watson
(74) *Attorney, Agent, or Firm*—Marshall, Gerstein & Borun LLP

(57) ABSTRACT

A centering device for a platform lift which includes a lifting mechanism for moving objects from a first to a second height. The lift mechanism has a base, at least a first and a second set of legs, and a platform. The first and second sets of legs each have first opposite ends pivotally secured to the base and the platform, respectively, and second opposite ends provide with traveling members to cooperate with the platform and base, respectively. The platform has a lower portion including a rail upon which the traveling members of the first set of legs traverse. Between the ends of each of the first set of legs, having the traveling members, and the rail, a centering device is disposed to provide alignment of the traveling members and the rails.

17 Claims, 3 Drawing Sheets

PLATFORM CENTERING DEVICE

FIELD OF THE DISCLOSURE

The disclosure relates to lifts in general, and more specifically to industrial scissor lifts.

BACKGROUND OF THE DISCLOSURE

Lift type devices have been used for many years, and in various applications. Lift type devices are, however, generally used to raise and lower objects or people from a first elevation to a second elevation. Just as there are various types of lifts and lift type devices, there are many possible power modules capable of performing the required actions necessary to properly utilize the lift. The different power modules may include, but are not limited to, manual input, electric systems, pneumatic systems, and hydraulic systems.

One of the many lift type devices, as mentioned above, is a scissor type lift. The scissor lift is named for the scissor like action of a set of legs used to raise and lower the lift. Typically, a scissor lift includes a set of complementary legs which are pivotally attached to each other at their respective centers. The first set of legs is usually pivotally attached to a base at one end, and has attached at the other end, rollers that are adapted to traverse on the underside of a platform. The second set of legs is usually pivotally attached to the platform at one end, and has attached at the other end rollers, that are adapted to traverse on the topside of the base. Disposed between the two sets of legs, is a power module that forces a scissor action, thereby creating the lifting and lowering of the platform. More specifically, the power module pulls and pushes the lower portion of the second set of legs, toward and away from the lower portion of the first set of legs, thereby creating a lifting motion.

The modern uses for a scissor lift are many, but scissor lifts are generally used to move large objects between two levels, or to place personnel into higher positions. For example, when transferring loads between a vehicle and a receiving platform or vice versa, it is generally more efficient and secure to transfer the load from the vehicle bed onto an essentially horizontal lift platform, and then onto the receiving platform, than having the load be manually lifted and lowered, inevitably titling the load and shifting or perhaps dropping the content. Similarly, when elevating personnel to higher positions, the scissor lift can provide a large horizontal platform on which to work, thereby giving the personnel a great amount of stability and efficiency.

Although the scissor lift is a useful device, having many applications and various benefits, today's scissor lift technology does have certain drawbacks and limitations, preventing it's full and efficient use. The area of contact between the rollers and platform, for instance, creates heavy wear, and is often the reason for failure of one of the two components. The wear between these two components is usually caused by several factors, including, but not limited to, the type of material used and misalignment of the components themselves. Similarly, the location of the load, on the platform, must be carefully calculated and placed. More specifically, the size and weight of the load must be taken into consideration, in an attempt to place the center of the load onto the center of the platform. Not centering the load, may cause additional wear on lift components, and may even prevent the lift from working properly.

Therefore there still remains the need for an improved lift type mechanism, and more specifically an improved scissor type lift.

SUMMARY OF THE DISCLOSURE

In accordance with one aspect of the disclosure, a centering device for a scissor lift is provided. The lift, being used for moving objects from a first to a second height may include a base, a first and a second set of legs, a platform, traveling members and a power module. The lower portion of the platform may include a rail upon which the traveling members traverse, the traveling members being connected to the first set of legs. The centering device, being disposed between the end of the first set of legs and the rail, may provide proper alignment between the traveling members, the rail and the platform.

In accordance with another aspect of the disclosure, a method of operation for a centering device for a scissor lift is provided. The method may include providing a lift that includes a base, a first and a second set of legs, a platform, traveling members and a power module. The method may entail moving an object or person from a first to a second height, all the while aligning the traveling members, the rail and the platform relative to each other, by disposing a centering device between the end of the first set of legs and the rail.

Figure 1:
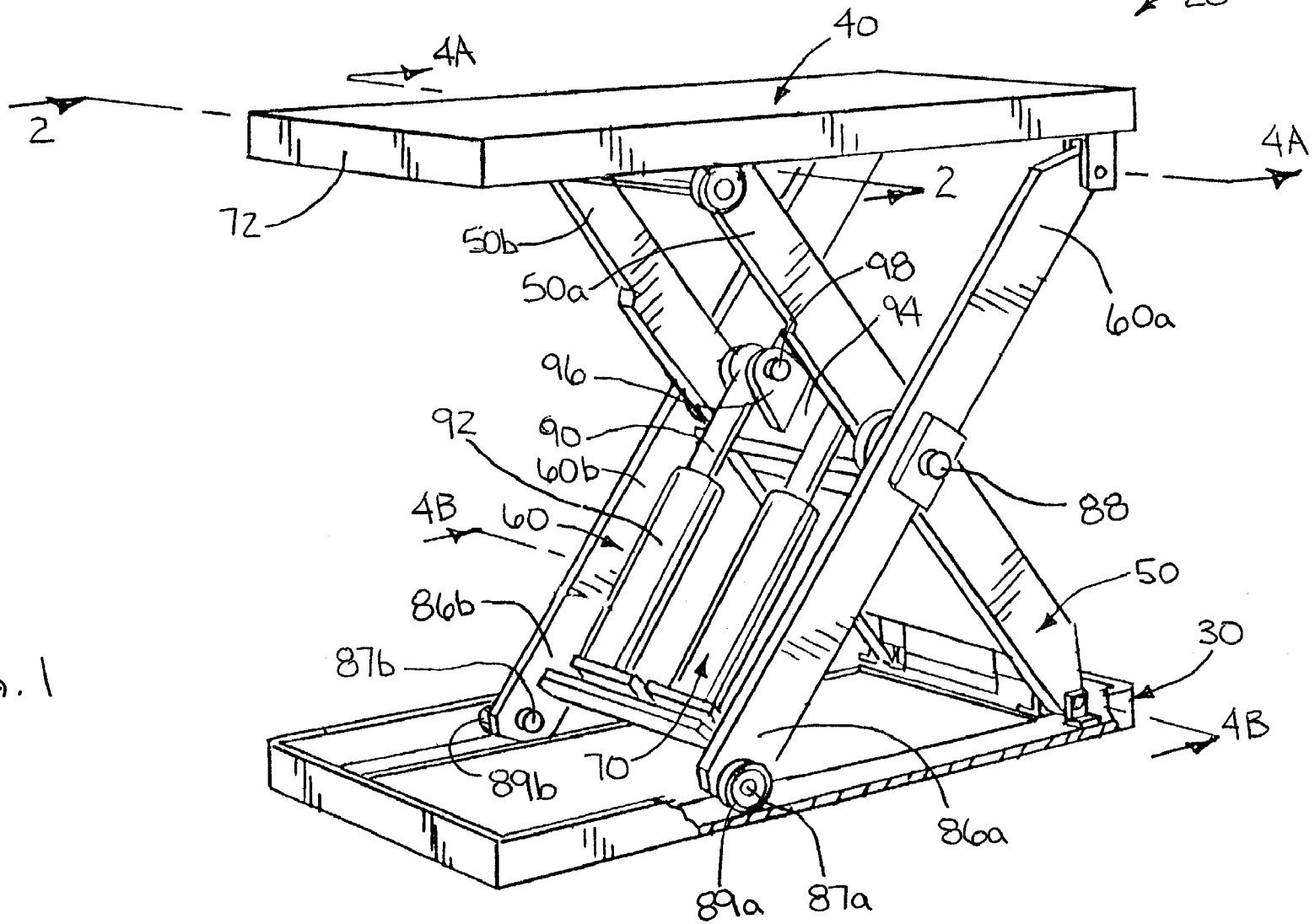
FIG. 1 is an isometric view of an industrial scissor lift constructed in accordance with the teachings of the disclosure.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION

Referring to FIG. 1, a scissor lift 20 may include a base 30 and a platform 40, having disposed therebetween a first pair of legs 50 and a second pair of legs 60 mounted in a scissor like manner, and a power unit 70, operatively connected between the first pair of legs 50 and the second pair of legs 60.

Figure 4A:
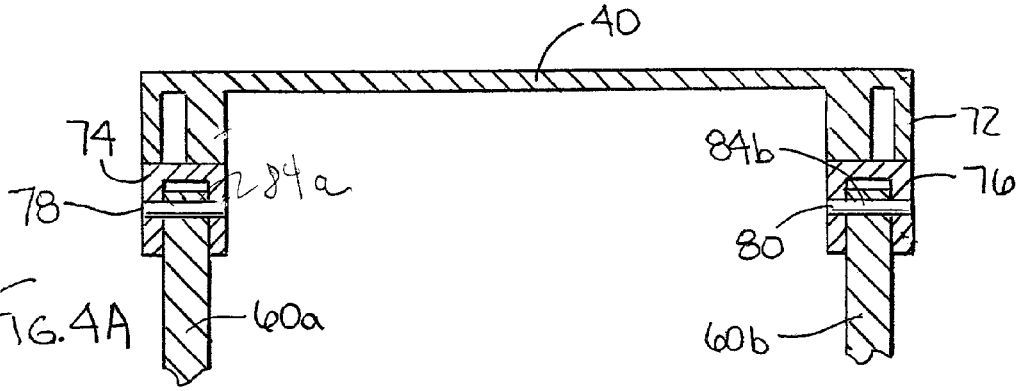
FIG. 4A is a cross-sectional view of the scissor lift of FIG. 1, taken along line 4A—4A of FIG. 1.
Figure 4B:
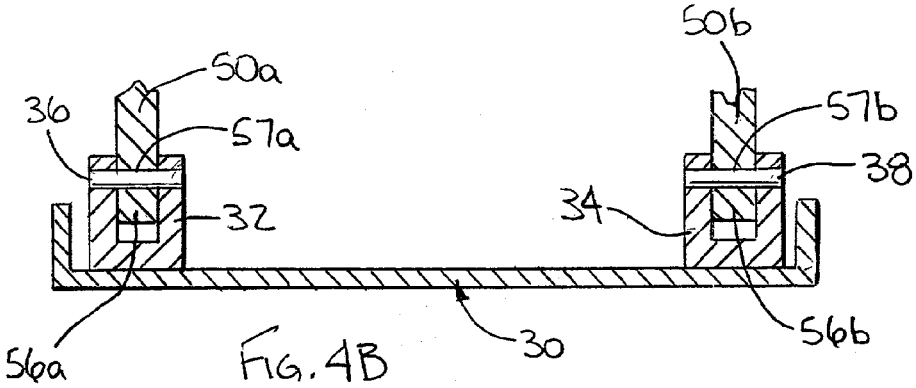
FIG. 4B is a cross-sectional view of the scissor lift of FIG. 1, taken along line 4B—4B of FIG. 1.

As shown in FIGS. 1 and 4B, the base 30 may be of general rectangular shape, and may be manufactured from steel, but may also be manufactured from any other suitable material. The base 30 may also be mounted to the floor, adding stability and strength to the lift 20. The lift 20, however, may also be mobile, enabling the lift 20 to be moved to and from different locations. Therefore, wheels may be mounted to the base 30, or the base 30 may be mounted on a wholly independent vehicle. The base 30 may further include a substantially flat bottom surface, framed by a substantially vertical wall. A first pivot mount 32 and a second pivot mount 34 may be fixedly connected to the base 30. For example, the mounts 32, 34 may be welded to the base 30. The first mount 32 may be adapted to receive a first pivot pin 36 and the second mount 34 may be adapted to receive a second pivot pin 38.

Figure 2:
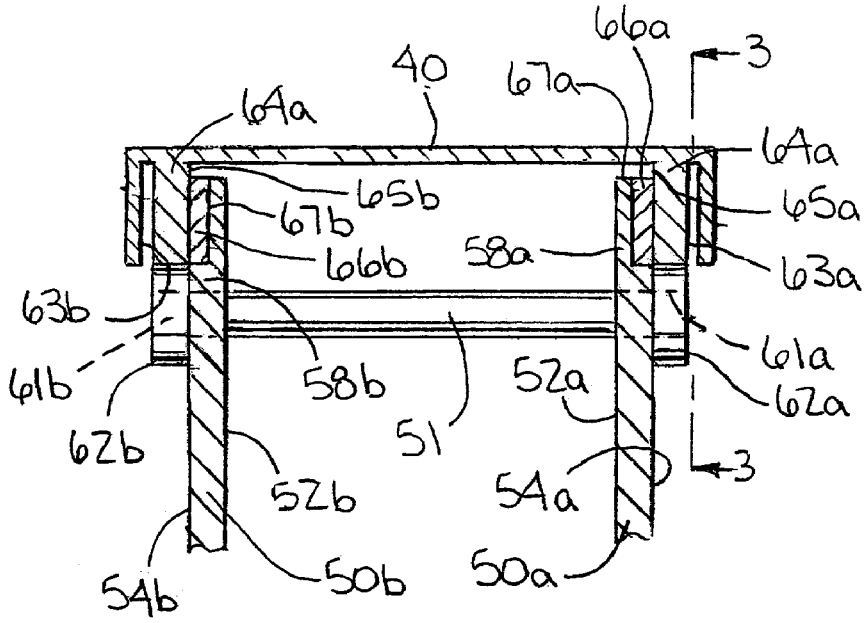
FIG. 2 is a cross-sectional view of the scissor lift of FIG. 1, taken along line 2—2 of FIG. 1.
Figure 3:
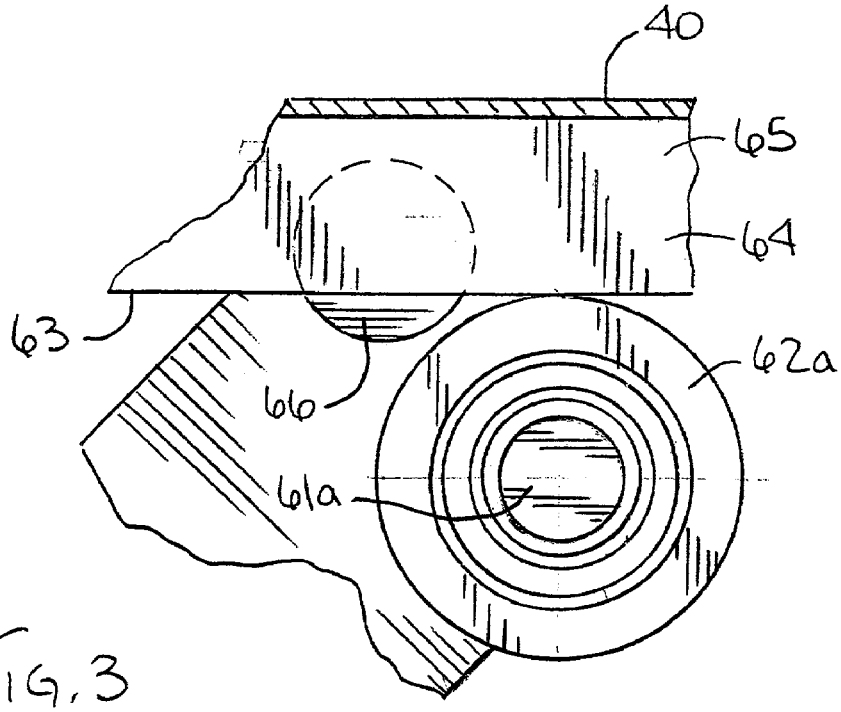
FIG. 3 is a cross-sectional view of the scissor lift of FIG. 1, taken along line 3—3 of FIG. 2.

Referring to FIGS. 2, 4A, and 4B the first set of legs 50, or "lower-mount" legs, may include two relatively parallel legs 50*a* and 50*b* that may be fixedly attached to each other at their respective centers or at their respective ends as at 51 (FIG. 2). The two legs 50*a* and 50*b* which make up the first set of legs 50 may have an elongated rectangular shape, including respective inside surfaces 52*a* and 52*b* and outside surfaces 54*a* and 54*b*, and may be situated such that the inside surfaces 52*a* and 52*b* of the two legs 50*a* and 50*b* are facing each other. Disposed at the lower or proximal ends 56*a* and 56*b* of each of the first set of legs 50, may be apertures 57*a* and 57*b*, such as mounting holes, which may be adapted to receive the first pivot pin 36 and the second pivot pin 38, respectively, thereby pivotally mounting the lower-mount legs 50 to the base 30.

As shown in FIG. 2, located at the upper or distal ends 58*a* and 58*b* of the lower-mount legs 50, may be apertures, adapted to receive respective shafts 61*a* and 61*b*. The shafts 61*a* and 61*b* may be adapted to receive respective traveling members 62*a* and 62*b*, such as rollers, which may then be mounted adjacent the outside surfaces 54*a* and 54*b* of the lower mount legs 50. Positioned above the rollers 62*a* and 62*b*, on the outside surfaces 54*a* and 54*b* of the distal ends 58*a* and 58*b* of the lower mount legs 50, may be respective counterbores 67*a* and 67*b*. Housed within the counterbores 67*a* and 67*b*, and adapted to abut a set of rails 64*a* and 64*b*, may be respective centering devices 66*a* and 66*b*, which may be round in shape, and may be manufactured from low friction material such as Nylatron®.

The platform 40 may rest upon the rollers 62*a* and 62*b*, and more specifically, the rails 64*a* and 64*b*, which may be fixedly attached to the bottom of the platform 40, may rest upon the rollers 62*a* and 62*b*. The rollers 62*a* and 62*b* may be industrial wheels which are designed to withstand a specific weight and/or a specific number of uses. The rails 64*a* and 64*b* may be of a general rectangular shape, with respective horizontal lower surfaces 63*a* and 63*b* acting as traveling member tracks or contact points, and with respective vertical sides 65*a* and 65*b* acting as guides by insuring the traveling members 62*a* and 62*b* stay in contact with the rails 64*a* and 64*b*. The platform 40 may also be of generally rectangular shape, and approximately equal in size to the base 30. The upper surface of the platform 40 may be generally level or horizontal, and may be adapted to lift objects and people. A skirt 72 may extend from the perimeter of the platform down in the vertical direction, which may prevent the exposition of the underside of the platform 40.

Referring to FIG. 4A, a third pivot mount 74 and fourth pivot mount 76 may be fixedly connected to the platform 40. The third pivot mount 74 may be adapted to receive a third pivot pin 78 and the fourth pivot mount 76 may be adapted to receive a fourth pivot pin 80. As shown in FIG. 1, the second set of legs or "upper mount" legs 60 may be pivotally attached to the lower mount legs 50 via a shaft 88 disposed near the center of the legs.

Referring to FIGS. 1 and 4A, the upper-mount legs 60, may also include two legs 60*a* and 60*b* that may be fixedly attached and relatively parallel to each other. The two legs 60*a* and 60*b* that make up the upper-mount set of legs 60, may be similar to the legs 50*a* and 50*b* that comprise the lower-mount legs 50 in that they each may have an elongated rectangular shape, including an inside surface and an outside surface, and may be situated such that the inside surfaces of the two legs 60*a* and 60*b* are facing each other. Disposed at the top or distal ends 84*a* and 84*b* of each of the upper mount legs 60, may be an aperture, such as a mounting hole, that may be adapted to receive the third pivot pin 78 and the fourth pivot pin 80, respectively, which may in conjunction with the third pivot mount 74 and the fourth pivot mount 76, pivotally mount the upper-mount legs 60 to the platform 40. Located at the lower or proximal ends 86*a* and 86*b* of the upper-mount legs 60, may be apertures adapted to receive shafts 87*a* and 87*b*. The shafts 87*a* and 87*b* may be adapted to receive traveling members 89*a* and 89*b*, such as rollers, that may be adapted to traverse along the flat bottom surface of the base 30.

More specifically, the shaft 88 may span completely through the first set of legs 50 and the second set of legs 60, wherein the center of the lower-mount legs 50 may be adapted to rotatably receive the shaft 88, and the center of the upper-mount legs 60 may be adapted to fixedly receive the shaft 88. It is also conceivable that the shaft 88 may be replaced by two separate shafts, thereby eliminating the presence of the shaft spanning between the sets of legs 50 and 60. As for other possible features, the shaft 88 may also include additional components, such as bearings, retaining rings and grease fittings to better accomplish the pivoting of the sets of legs relative to each other.

The movement of the lift 20 may be assisted by many different types of power units 70 (see FIG. 1), including, hydraulic, electric and pneumatic units. The hydraulic unit may include a piston 90, a cylinder 92 and a high pressure pump (not shown). As one skilled in the art will know, the hydraulic unit may have more than one pump, and more than one piston 90 and cylinder 92. To create the motion and force necessary to move the lift 20, hydraulic liquid may be pushed by the pump into the cylinder 92. The cylinder 92, now housing an increase of high pressure fluid, may concentrate the high pressure of the fluid toward the piston 90, enabling the piston 90 to move.

In operation, one objective of the lift 20 may be to move an object from a first position to a second position. The object being moved may be of a great variety of shapes, sizes and weight, ranging from small to large and from light to heavy objects, not excluding people. The distance the object may be moved, may also vary from lift to lift depending on the amount of travel that is required for a specific application.

Figure 5:
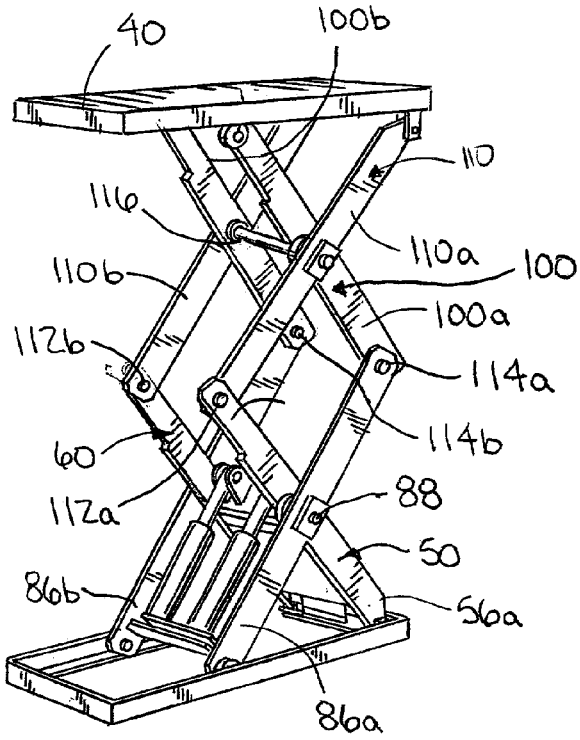
FIG. 5 is an isometric view of a two-scissor scissor lift constructed in accordance with the teachings of the disclosure.

To accommodate for the variety of distances necessary to move objects, several techniques may be employed. The sets of legs 50, 60 for instance, may be made longer or shorter depending on the application, thereby relatively increasing or decreasing the amount of vertical travel obtained. Similarly, multiple sets of legs (scissors) may be added, thereby increasing the amount of travel by a multiple of the number of scissors in the lift. For example, the scissor action of the first set of legs 50 and second set of legs 60, being a single scissor, may combine for a vertical travel of X. The addition of a third set of legs 100 and fourth set of legs 110 as shown in FIG. 5, now providing a double scissor, may increase the vertical travel to 2X, etc.

It should be realized that the addition of a set of scissors adds to the linkage configuration of the lift, whereby the legs 50*a* and 50*b* of the first set of legs 50 are pivotally attached to the corresponding legs 110*a* and 110*b* of the fourth set of legs 110 as at 112*a* and 112*b*, respectively, wherein the legs 50*a* and 50*b* comprise first links and the legs 110*a* and 110*b* comprise second links. Similarly, the legs 60*a* and 60*b* of the second set of legs 60 are pivotally attached to the corresponding legs 100*a* and 100*b* of the third set of legs 100 as at 114*a* and 114*b*, respectively, wherein the legs 60*a* and 60*b* comprise third links and the legs 100*a* and 100*b* comprise fourth links. With this arrangement, the first and third links comprised of sets of legs 50 and 60 may be pivotally connected by the shaft 88 disposed near the center of the legs 50*a*, 50*b*, and 60*a*, 60*b* and the second and fourth links comprised of sets of legs 100 and 110 may be pivotally connected by a shaft 116 disposed near the center of the legs 100*a*, 100*b* and 110*a*, 110*b*.

As additional scissors or combinations of legs are added, more links are provided, but the basic scissor principle remains the same. As shown in FIG. 5, the only requirement is for one of the linkages (such as the first links 50*a* and 50*b*) to be pivotally mounted to the base 30, and the other of the linkages (such as the third links 60*a* and 60*b*) to have traveling members cooperating with the base 30 and, similarly, for one of the linkages (such as the second links 110*a* and 110*b*) to be pivotally mounted to the platform 40 and the other of the linkages (such as the fourth links 100*a* and 100*b*) to have traveling members cooperating with the platform 40.

In order to understand the operation of the scissor lift, the single-scissor embodiment of FIGS. 1–4B wherein, to initiate the lifting process, the power module 70, such as the illustrated hydraulic system, is activated. The pumping mechanism and fluid storage (not shown) for the hydraulic system may be located within the area bounded by the first set of legs 50, and the pistons 90 and the cylinders 92 may be located in the area bounded by the second set of legs 60. Upon activation, the fluid entering the cylinders 92 may force the pistons 90 outward and, similarly, when the fluid is removed from the cylinders 92, the pistons 90 may retract into the cylinders 92. The cylinders 92, being fixedly attached to the second set of legs 60 near the distal ends 86*a* and 86*b* of the legs 60*a* and 60*b*, and the pistons 90, being operatively attached to a pivot bar 94, may create in combination, the motion and force necessary for lifting the object.

The pivot bar 94 may be a one piece bar or rod, but it may also consist of more than one piece depending on the lift. For example, a lift that utilizes a single pivot bar, may have the pivot bar extend through the center of the lower-mount legs 50 and the center of the upper-mount legs 60, thereby providing the sets of legs 50, 60 a point about which to pivot. The pivot bar 94, may also comprise or be a part of the shaft 88. Similarly, a lift that utilizes two discrete pivot bars may have one of the pivot bars associated with corresponding lower-mount and upper-mount legs 50*a* and 60*a*, while the other of the pivot bars may be associated with corresponding lower-mount and upper-mount legs 50*b* and 60*b*. Fixedly attached to the pivot bar 94, may be yokes 96, that are adapted to secure the pistons 90 as with pins 98. More specifically, the yokes 96 may be fixedly attached to the pivot bar or bars 94, and have disposed at the opposite end apertures, adapted to receive the pins 98. Furthermore, the yokes 96 may be positioned on the pivot bar or bars 94 in such a manner, as to properly leverage the power from the power module 70, to thereby optimize the effectiveness and efficiency of the lift 20.

When in the lowered position, the platform 40 of the lift 20 may rest on or near the ground, so that the load may be easily placed on to the platform 40. Off-center loading of the platform 40 may have little or no effect when the lift 20 is in the resting position, but may greatly affect the wear and efficiency of the components once the lift 20 is in motion. When placing the load toward one of the sides of the platform 40, the platform 40 may have a tendency to twist or turn depending on the exact placement and weight of the load.

As the power module 70 is activated, the traveling members 62*a* and 62*b* mounted on the distal ends 58*a* and 58*b* of the lower mount legs 50 (lower mount rollers) may begin to traverse along the rails 64*a* and 64*b* on the underside of the platform 40, while simultaneously, the traveling members 62*b* mounted on the distal ends 86*a* and 86*b* of the upper mount legs 60 (upper-mount rollers) may begin to traverse along the upper side of the base 30. More specifically, the lower-mount rollers 62*a* and 62*b* may begin to traverse along the rails 64*a* and 64*b* toward the third and fourth pivot mounts 74,76, and the upper-mount rollers 89*a* and 89*b* may begin to traverse toward the first and second pivot mounts 32, 34, creating the vertical displacement of the platform 40.

As the vertical displacement occurs, several forces, including that of the load may distribute unevenly among the components. These uneven distributions, in turn, may create tensions and areas of concentrated forces between the components, leading to misalignment between the traveling members 62*a* and 62*b* and the rails 64*a* and 64*b*, and similarly, to misalignment between the first and the second sets of legs 50, 60, the platform 40 and the base 30. Aiding in the reduction of tension and reducing areas of concentrated forces, the centering devices or guides 66*a* and 66*b*, being located within the respective bores 67*a* and 67*b*, and disposed between the outside surfaces 54*a* and 54*b* of the of legs 50*a* and 50*b* and the corresponding rails 64*a* and 64*b*, may strategically ensure the proper alignment of the different lift components.

For example, if a load is placed on the outside edge of the platform 40, the platform 40 may have a tendency to tilt to the load bearing side, thereby misaligning the lower mount rollers 62*a* and 62*b* and the corresponding rails 64*a* and 64*b*, or possibly fully concentrating the weight of the platform 40 on a single roller, while raising or distancing the other roller from its rail. If the lower mount rollers 62*a* and 62*b* and the corresponding rails 64*a* and 64*b* are misaligned, or whether one the rollers bears the entire weight of the platform 40 and its load, several components, such as the rollers 62*a* and 62*b*, the rails 64*a* and 64*b* and the first and second sets of legs 50 and 60, may experience extensive wear. More specifically, as the platform 40 tilts or moves toward one side, the roller 62*a* may undergo significant sliding friction against the corresponding rail 64*a*, the leg 50*a* may grind and rub against the corresponding rail 64*a*, and the roller 62*a* may grind against the corresponding leg 50*a*. The centering guides 66*a* and 66*b*, however, prevent the misaligning of the lower mount rollers 62*a* and 62*b* with their corresponding rails 64*a* and 64*b*, and prevent the rollers from raising or distancing themselves from the rails or experiencing significantly uneven forces or wear, by limiting or eliminating the unwanted play between the components, and by ensuring that the components, such as the first and second sets of legs 50 and 60, the rails 64*a* and 64*b* and the corresponding rollers 62*a* and 62*b*, are aligned. As a consequence of alignment of the different components, due to the centering guides 66*a* and 66*b*, the platform 40 and the base 30 may be able to achieve continued and substantial parallelism. More specifically, the centering devices 66*a* and 66*b* may be fixedly attached to the outside surfaces 54*a* and 54*b* of the distal ends 58*a* and 58*b* of the lower mount legs 50, and disposed between the legs 50*a* and 50*b* thereof and the corresponding rails 64*a* and 64*b*. As the rollers 62*a* and 62*b* traverse along the corresponding rails 64*a* and 64*b*, they may contact the corresponding inside surfaces 65*a* and 65*b* of the rails 64*a* and 64*b*, thereby preventing legs 50*a* and 50*b* from contacting the corresponding rails 64*a* and 64*b* and ensuring that the rollers 62*a* and 62*b* remain substantially perpendicular to and in alignment with the corresponding rails 62*a* and 62*b* at all times.

Similarly, when the load is placed on the center of the platform 40, the centering devices 66*a* and 66*b* are still an integral part of the lift 20, ensuring alignment of the various components such as the rollers 62*a* and 62*b*, the rails 64*a* and 64*b*, and the first and second sets of legs 50 and 60. For example, even though the load is placed on the center of the platform 40, the centering devices 66*a* and 66*b* prevent the rollers 62*a* and 62*b* from rubbing and grinding against the respective legs 50*a* and 50*b*, by demanding a slight distance or separation between the legs 50*a* and 50*b* and their corresponding rollers 62*a* and 62*b*.

The foregoing detailed description has been given for clearness of understanding only and no unnecessary limitations should be understood therefrom, as modifications will be obvious to those skilled in the art.

What is claimed is:

1. A lift comprising:

a lifting mechanism for moving objects from a first to a second height, including a base, a first set of legs, a second set of legs, a power module, and a platform;

the legs each having a proximal end and a distal end;

the proximal ends of the first set of legs each being secured to the base, and the distal ends each having a traveling member;

the proximal ends of the second set of legs each being secured to the platform, and the distal ends each having a traveling member;

the platform having a lower portion including a rail upon which each of the traveling members of the first set of legs traverse; and a low-friction wear resistant pad disposed between each of the distal ends of the first set of legs and the corresponding rail to provide alignment of the traveling members with the rails.

2. The lift of claim 1, wherein the pad is made from Nylatron®.

3. The lift of claim 1, wherein the pad is round.

4. The lift of claim 1, wherein the pad provides substantial parallelism between the platform and the base.

5. The lift of claim 1, wherein the power module is a hydraulic cylinder.

6. The lift of claim 1, wherein additional sets of legs are disposed between the base and the platform.

7. A centering device for a platform on a lift comprising:

a lifting mechanism including a base and a set of legs having first ends pivotally secure to the base and having traveling members associated with second ends opposite the first ends, a second set of legs, and traveling members:

the platform having a lower portion including a rail upon which each of the traveling members of the set of legs traverse; and a low-friction wear resistant pad disposed between each of the second ends of the set of legs and the corresponding rail to provide alignment of the traveling members with the rails.

8. A lift comprising:

a lifting mechanism for moving objects from a first to a second height including a base, a combination of legs, a platform, traveling members and a power module;

the combination of legs including at least a first pair of legs having a first travel end and a first pivot end and including at least a second pair of legs having a second travel end and a second pivot end;

the first and second travel ends being opposite one another and including a traveling member associated with each of the legs of the first and second pairs of legs at the respective travel ends thereof;

the first pivot end of the first pair of legs being pivotally attached to the base, and the second pivot end of the second pair of legs being pivotally attached to the platform;

the platform having a lower portion including rails upon which each of the traveling members of the legs of the first pair of legs traverse; and a low-friction wear resistant pad disposed between the rails and the first travel ends of each of the legs of the first pair of legs to provide alignment of the traveling members with the rails.

9. A scissors lift comprising:

abase;

a platform;

at least a pair of legs operatively connecting the base to the platform, each pair of legs including a proximal end and a distal end, the distal ends of one pair of legs being secured to the platform, and the distal ends of the other pair of legs moving relative to the platform;

traveling members disposed near the ends of the other pair of legs, the traveling members engaging rails connected to the platform; and a wear-resistant insert located on at least one of the other pair of legs between the at least one leg and one of the rails.

10. The scissors lift of claim 9, wherein the traveling members are rollers that engage a bottom surface of the rails.

11. The scissors lift of claim 9, wherein at least a portion of the insert is disposed above the traveling member.

12. The scissors lift of claim 9, wherein the insert abuts the rail.

13. The scissors lift of claim 9, wherein the insert slidingly engages the rail.

14. The scissors lift of claim 9, wherein the insert protrudes outwardly from an outer portion of the at least one of the other pair of legs.

15. The scissors lift of claim 9, wherein at least a portion of the insert occupies a space between the traveling member and the rail.

16. The scissors lift of claim 9, further including additional pairs of legs disposed between the base and the platform.

17. The scissors lift of claim 9, wherein the insert is replaceable.

* * * * *

UNITED STATES PATENT AND TRADEMARK OFFICE

CERTIFICATE OF CORRECTION

PATENT NO. : 6,974,123 B2
APPLICATION NO. : 10/115514
DATED : December 13, 2005
INVENTOR(S) : Evaldas Latvys It is certified that error appears in the above-identified patent and that said Letters Patent is hereby corrected as shown below:

Column 8, Line 27

Please delete "abase;" and insert -- a base; -- in its place.

Signed and Sealed this

Seventh Day of November, 2006

JON W. DUDAS
*Director of the United States Patent and Trademark Office*